US005458200A

United States Patent [19]

Lagerlef et al.

[11] Patent Number: 5,458,200

[45] Date of Patent: Oct. 17, 1995

[54] SYSTEM FOR MONITORING GAS LIFT WELLS

[75] Inventors: David L. Lagerlef, Eagle River; Jerry L. Brady; Stephen Gerlek, both of Anchorage, all of Ak.; Charles M. Hightower, Plano; Raymond Wydrinksi, Lewisville, both of Tex.

[73] Assignee: Atlantic Richfield Company, Los Angeles, Calif.

[21] Appl. No.: 263,594

[22] Filed: Jun. 22, 1994

[51] Int. Cl.[6] ..... E21B 34/16; E21B 43/12

[52] U.S. Cl. ..... 166/372; 166/53

[58] Field of Search ..... 166/372, 53, 117.5, 166/117.6

[56] References Cited

U.S. PATENT DOCUMENTS

| | | | |
|---|---|---|---|
| 4,410,038 | 10/1983 | Drapp | 166/53 |
| 4,791,990 | 12/1988 | Amani | 166/372 X |
| 4,989,671 | 2/1991 | Lamp | 166/372 X |
| 4,992,997 | 2/1991 | Bseisu | 367/82 |
| 5,031,697 | 7/1991 | Wellington et al. | 166/372 X |
| 5,038,614 | 8/1991 | Bseisu et al. | 73/592 |
| 5,146,991 | 9/1992 | Rogers, Jr. | 166/53 X |
| 5,166,908 | 11/1992 | Montgomery | 367/165 |
| 5,319,610 | 6/1994 | Airhart | 367/82 |

*Primary Examiner*—William P. Neuder
*Attorney, Agent, or Firm*—Michael E. Martin

[57] ABSTRACT

Multiple gas lift valves interposed in a well tubing string are each configured to have gas flow ports adapted to emit a predetermined acoustic signal for transmission through the well to a microphone or similar acoustic signal receiver whereby a determination may be made of which gas lift valves are open or operating properly. One or more of the gas lift valves may also include fluid pressure, temperature and viscosity sensors as well as a valve opening sensor and/or valve pressure setting control and an associated signal controller/generator arrangement for generating signals for transmission to the surface. The signal generators may be of the acoustic or so-called stress wave type.

20 Claims, 2 Drawing Sheets

SYSTEM FOR MONITORING GAS LIFT WELLS

BACKGROUND OF THE INVENTION

1. Field of the Invention

The present invention pertains to a system for monitoring the operation of one or more gas lift valves in a fluid production well and wherein the system includes sensors for detecting which gas lift valves are functioning and sensors for detecting certain properties of the produced fluid flowing in the tubing in the vicinity of one or more of the gas lift valves.

2. Background

One method of artificial lift of liquids from wells that either will not flow, or not flow at optimum rates, comprises injecting pressure gas at various points along the well production fluid tubing string to assist in "lifting" fluids to the surface. Gas lift systems usually include a plurality of spaced-apart pressure operated valves which are adapted to open at a predetermined gas pressure to admit the lift gas into the production tubing.

However, optimum lifting conditions are not always achieved after the gas lift valves have been installed due to changes in the fluid production characteristics of the well or malfunctioning of one or more of the gas lift valves, for example. If optimum gas lift operation is not being achieved in conventional gas lift systems, it is necessary to retrieve each of the gas lift valves to determine if it is functioning properly or to change the pressure conditions under which the valve is set to open. Still further, it is often necessary and desirable to determine the pressure, temperature and viscosity, for example, of the fluid being produced from the well so that certain adjustments to the operation of the gas lift system may be carried out to improve well production. The present invention overcomes some of the deficiencies and problems associated with prior art gas lift wells by providing a system for monitoring the operation of one or more gas lift valves and for transmitting information concerning the conditions of the produced fluid in the production tubing string at selected ones of the gas lift valves.

SUMMARY OF THE INVENTION

The present invention provides a system for monitoring the operation of a gas lift well including determining which gas lift valves are functioning, and determining certain properties of the produced fluid flowing through the production tubing string in the vicinity of selected ones of the gas lift valves.

In accordance with one important aspect of the present invention, a system for monitoring the operation of multiple gas lift valves in a fluid production well is provided wherein each gas lift valve and/or its supporting mandrel is provided with a suitable and different "acoustic signature" by sizing one or more of the gas flow ports to emit an acoustic signal of a predetermined frequency when gas is flowing therethrough. By providing certain sensors at or near the wellhead, for example, those valves which are or are not operating may be identified.

In accordance with another important aspect of the present invention, a system is provided for detecting whether or not a gas lift valve is functioning in a gas lift well and a signal related thereto is produced for transmission through the production tubing string to the surface.

Still further in accordance with the invention, a system for monitoring the operation of a production well on gas lift or similar artificial lift operation is provided wherein certain properties of the production fluid flowing through the tubing string in the vicinity of a gas lift valve are determined by sensing such parameters as pressure, temperature and fluid viscosity. Signals related to the values of these parameters are then transmitted to the surface by, for example, imposing suitable vibrations on the production tubing string which are sensed at or near the surface. The sensed vibrations are then converted into suitable readable signals indicating the parameters being monitored at the selected gas lift valves.

In accordance with yet a further aspect of the present invention, a system is provided for monitoring the operation of a gas lift well wherein sensor and signal generating and conversion devices are associated with one or more gas lift valves and these devices may be activated or deactivated by suitable signals transmitted from the surface to the respective gas lift valve units.

Those skilled in the art will further appreciate the above-described features of the present invention together with other superior aspects thereof upon reading the detailed description which follows in conjunction with the drawing.

DESCRIPTION OF PREFERRED EMBODIMENTS

Figure 1:
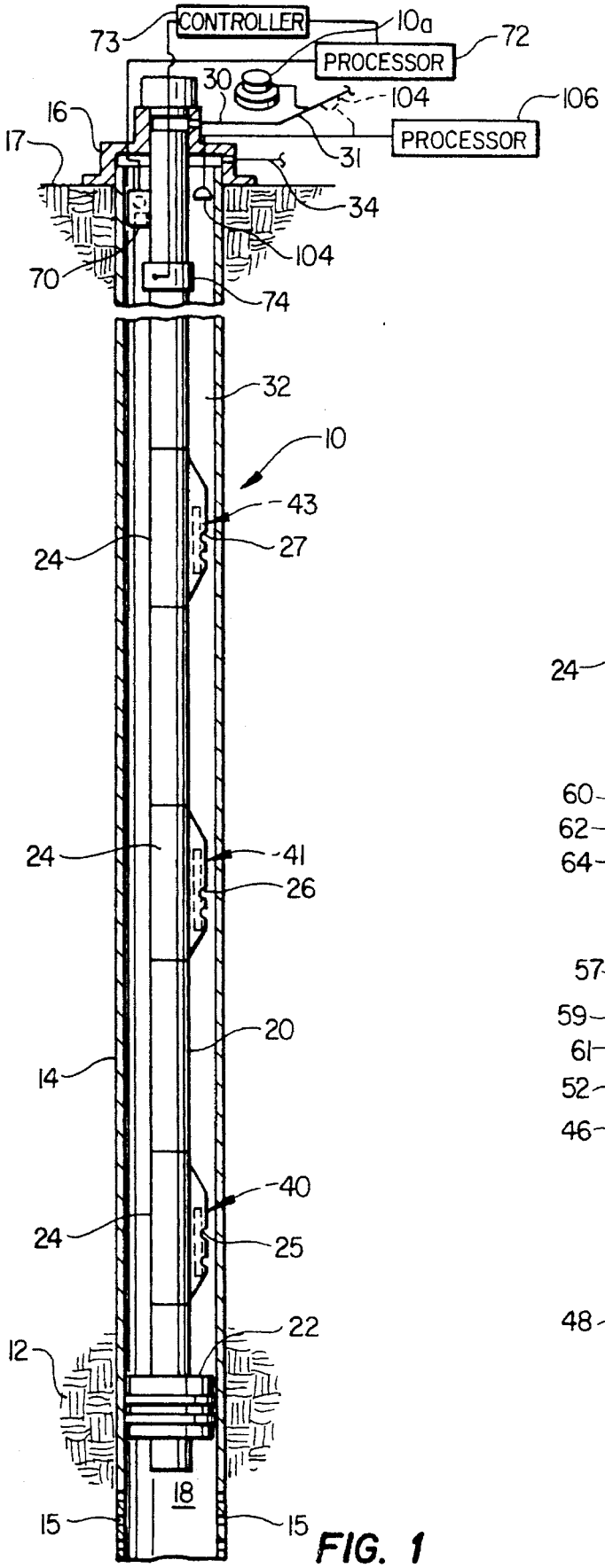
FIG. 1 is a view in somewhat schematic form of a fluid production well which includes plural spaced-apart gas lift valves and a system for monitoring the operation of the valves in accordance with the present invention.

In the description which follows, like elements are marked throughout the specification and drawing with the same reference numerals, respectively. The drawing figures are not necessarily to scale and certain elements are shown in somewhat schematic or generalized form in the interest of clarity and conciseness.

Referring to FIG. 1, there is illustrated a fluid production well 10 for producing fluid such as crude oil from a petroleum reservoir 12. The well 10 includes a casing 14 extending from a wellhead 16 disposed at the surface 17 of an earth formation which includes the reservoir 12. The well 10 has been adapted to produce fluids from the reservoir 12 through suitable perforations 15 in the casing 14 into wellbore 18 and through a tubing string 20 which extends from the wellhead 16 to and through a conventional packer 22. Plural mandrels 24 are interposed in the tubing string 20 in a conventional manner and each include a set of ports 25, 26 and 27, respectively, for admitting pressure fluid, preferably gas, to respective and unique gas lift valves 40, 41 and 43 to be described in further detail herein. The gas lift valves 40, 41 and 43 are operable for admitting pressure gas into the tubing string 20 to assist in lifting fluids such as crude oil and produced water to the surface 17 for flow out of the wellhead 16 by way of a conduit 30. Pressure gas is admitted to the annular space 32 between the tubing string 20 and the casing 14 from a suitable source, not shown, by way of a conduit 34 connected to wellhead 16.

Figure 2:
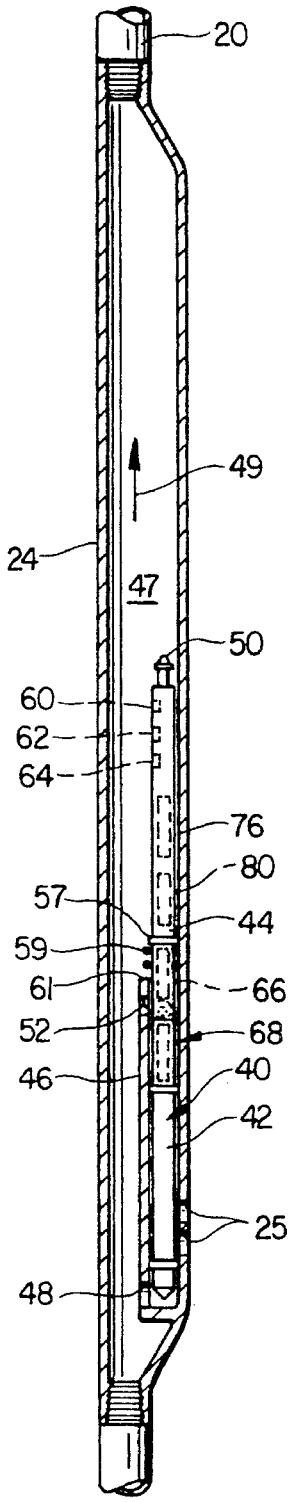
FIG. 2 is a detail section view of one of the gas lift mandrels from the well of FIG. 1 showing the location of the improved signal transmitting gas lift valve in accordance with the invention.

Referring also to FIG. 2, the lowermost gas lift mandrel 24 in the tubing string 20 is shown in a longitudinal central cross-section view to reveal the unique gas lift valve assembly, generally designated by the numeral 40. The gas lift valve assembly 40 includes a first body member 42 which houses a gas lift valve and signal transmitter device to be described in further detail and a second body member 44 which serves as a housing for certain control elements to also be described in further detail herein. The gas lift valve 40 is adapted to be inserted in a generally tubular pocket formed by the mandrel 24 and an internal partition 46. The gas lift mandrel 24 may, by way of example, be substantially of a type commercially available such as a type sold under the trademark TRU-GUIDE by Halliburton Company, Dallas, Tex. The mandrel 24 may also be of so-called conventional construction also commercially available from Halliburton Company as well as other sources. An internal passage 47 is formed in the mandrel 24 to conduct production fluid through the tubing string 20 toward the surface.

Pressure gas is admitted into the mandrel 24 through the ports 25 and flows through the gas lift valve 40 and a port 48 into the passage 47 to assist in conveying or "lifting" fluids through the passage in the direction of arrow 49 in FIG. 2.

The gas lift valve assembly 40 may be of a type which is adapted to be inserted in the mandrel 24 and withdrawn therefrom using a conventional tool of a type commercially available from Halliburton Company. The gas lift valve assembly 40 includes a retrieval head member 50 attached to the body 44 and a suitable retaining latch 52 engageable with the partition 46 for latching the valve assembly in the so-called side pocket formed by the partition 46 and the body of the gas lift mandrel. The latch 52 is pivotally supported on the body 44 and is engageable with a shear pin 53 which is operable to retain the latch in engagement with the body 44 via a slot 55 until a predetermined upward pulling force is exerted on the valve assembly 40 by a suitable retrieval tool, not shown. As shown in FIG. 2, an annular collar 57 on the body 44 retains a coil spring 59 between the body and the transverse end face 61 of the partition 46 to hold the latch 52 in firm engagement with the partition at the slot 55.

The body member 44 of the valve assembly 40 includes plural sensors 60, 62 and 64 disposed thereon and which are operable to sense certain parameters of the fluid flowing through the passage 47 such as, for example, pressure, temperature and fluid viscosity. The signals generated by the sensors 60, 62 and 64 are transmitted to a suitable controller 66 which is operable to provide an output signal to control the operation of a signal generator or transmitter 68. The signal generator 68 is operable to impose suitable vibratory or acoustic wave signals to the body 44 and the mandrel 24 for transmission along the tubing string 20 toward the surface where a signal receiver 70 is connected to the tubing string 20, as shown in FIG. 1. Accordingly, suitable signals, including those related to the pressure, temperature and viscosity of the fluid flowing through passage 47, may be transmitted to the signal receiver 70 and from the receiver to a signal processor and analyzer 72.

As shown in FIG. 1, the signal processor and analyzer 72 is also operably connected by way of a controller 73 to a second signal generator 74 interposed in the tubing string 20 near the wellhead 16 and operable to transmit acoustic wave signals, for example, down through the tubing string 20 to be sensed by a suitable receiver 76 disposed on the body 44. Accordingly, certain command signals may be transmitted from the surface to each of the gas lift valves for performing certain operations to be described herein. A suitable power supply such as storage batteries 80, or a downhole fluid powered generator, not shown, may also be disposed in the body 44 for operating the sensors 60, 62 and 64, the signal controller 66 and the signal receiver 76, for example.

Figure 3:
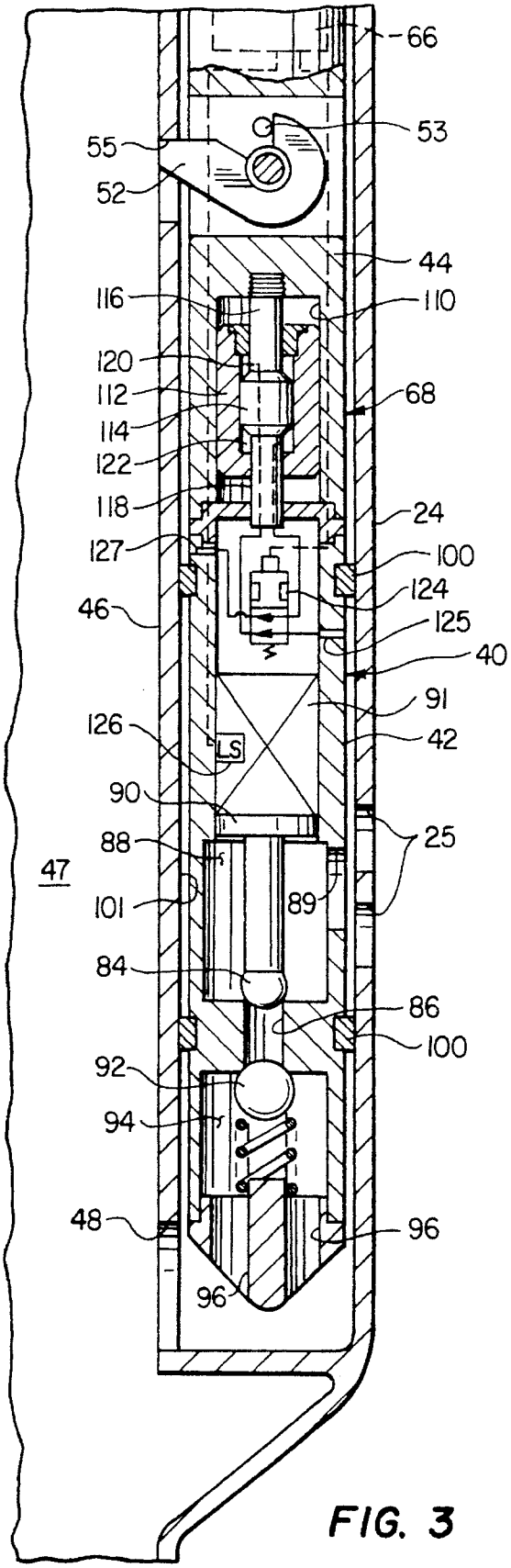
FIG. 3 is a detail section view of an improved gas lift valve assembly in accordance with the invention.

Referring now to FIG. 3, the gas lift valve assembly 40 includes certain substantially conventional gas lift valve mechanism in addition to the improvements of the present invention. The body 42 is adapted to support a gas lift valve closure member 84 which is operable to be seated to close a passage 86. The closure member 84 is operable, when biased by a pressure gas admitted to a chamber 88, to effect movement of a piston 90 upwardly, viewing FIG. 3, to allow pressure gas to be admitted from the ports 25 through a port 89 into the chamber 88 to flow through the passage 86 and to unseat a check valve closure member 92 to admit pressure gas to flow through a chamber 94 and passages 96 and then by way of the port 48 into the internal passage 47 of the gas lift mandrel. Conventional annular seals 100 are disposed spaced apart on the body 42 and engageable with a borewall 101 formed by the body of the mandrel 24 and the partition 46 to allow gas to flow into the passage 47 by way of the ports 25, the port 89, the chamber 88, the passage 86, the chamber 94, the passages 96 and the port 48.

The ports 25, 86 and/or 89 may be configured to have a predetermined acoustic signature, that is, these ports may be configured to generate certain acoustic vibrations when fluid is flowing therethrough and which vibrations may be transmitted through the annular space 32 toward the surface and be sensed by a suitable microphone 104, FIG. 1. The microphone 104 is operably connected to a signal receiver and analyzer 106 for detecting the acoustic signal generated as gas flows through the ports 25, 86 and/or 89. The microphone 104 is shown disposed in the well annulus space 32 but may be suitably connected to the wellhead 16 or disposed in or connected to the production fluid flowline 30. As shown in FIG. 1, the gas lift mandrels 24 have the separate gas lift valve assemblies 40, 41 and 43 disposed therein, respectively, and each of these gas lift valve assemblies may be similar in most respects but have a port similar to the port 89 which is different in its configuration in such a way as to generate an acoustic signal of a different frequency. Alternatively, the ports 25, 26 and 27 may each also be configured differently so that when gas is flowing through these ports, respectively, an acoustic signal of a predetermined frequency is generated which is associated with the respective gas lift valve assemblies. In this way, signals received by the microphone 104 may be analyzed to determine which of the gas lift valves 40, 41 and 43 and/or mandrels 24 are operating to admit pressure gas into the tubing string 20. This information can be useful to the well operator to either modify the pressure of gas being admitted to the space 32 or to retrieve a particular gas lift valve assembly for adjustment or repair, as required. As shown in FIG. 1, the flowline 30 may be connected to a common fluid gathering conduit 31 and the microphone 104 may be suitably connected to such a conduit for sensing signals from one or more wells 10 and **10*a***, for example. Each valve in each well would emit signals of predetermined frequency for identification of which gas lift valves were functioning properly.

Referring further to FIG. 3, the exemplary signal generator 68 illustrated is characterized by a bore 110 formed in the body 44 and adapted to slidably receive a cylindrical reciprocating mass 112 which is sleeved over a stationary piston 114 having opposed coaxial rod portions 116 and 118, respectively. Opposed chambers 120 and 122 are formed in part by the reciprocating mass 112 and the piston 114. Pressure fluid such as pressure gas may be admitted to the chambers 120 and 122 by way of a suitable control valve 124. The valve 124 is in communication with pressure gas from the space 32 by way of a port 125 in body 42 and spent gas is exhausted via a port 127 to the passage 47. The valve 124 is operated by the controller 66 to effect reciprocation of the mass 112 at a certain frequency to cause the transmission of vibrations through the body 44 and the latch 52 to the partition 46. In this way, suitable acoustic or so called stress wave type signals may be transmitted from the mandrel 24 through the tubing string 20 to be received by the receiver 70 and for transmission to the signal processor and analyzer 72. Selected signals may be transmitted by the signal generator 68 indicating conditions of pressure, temperature and viscosity as determined by the sensors 60, 62 and 64.

Still further, the controller 66 may be adapted to determine whether or not the gas lift valve closure member 84 is in an open or closed position as determined by a limit switch 126 associated with the piston 90 and a bellows type operating member 91 operably connected to the piston. Accordingly, the position of the valve closure member 84 may also be determined by transmitting a signal with the generator 68, receiver 70 and signal processor and analyzer 72 together with the signals representing the parameters sensed by the sensors 60, 62 and 64. Of course, the gas lift valves 41 and 43 are also equipped with features similar to that described for the valve assembly 40 for transmitting signals related to the condition of each of these valves as well as the parameters of pressure, temperature and viscosity of the fluids flowing through the tubing string 20 at the locations of the gas lift mandrels associated with the valves 41 and 43. In this way, the well operator may also determine if the gas lift conditions should be modified including, for example, if certain chemicals should be injected into the gas lift flowstream to modify the produced fluid viscosity.

The signal generator 68, the controller 66 and the receiver 70 may be of a type described in U.S. Pat. No. 5,319,610, issued Jun. 7, 1994 to Tom P. Airhart and assigned to the assignee of the present invention. The subject matter of U.S. Pat. No. 5,319,610 is incorporated herein by reference. The arrangement of selected transducers disposed in the receiver 70 may be similar to that described in U.S. Pat. No. 4,715,451 or U.S. Pat. No. 5,038,614, both issued to A. A. Bseisu and assigned to the assignee of the present invention. For example, the controller 68 may include a suitable analog-to-digital signal converter connected to a microprocessor which in turn is operably connected to a frequency control circuit and a frequency shift key modulator for operating the control valve 124. The receiver 70 may include transducers arranged in accordance with U.S. Pat. No. 4,715,451 and the signal processor and analyzer 72 may also include a suitable frequency shift key demodulator which is communicated to a sender unit for transmission to a suitable data processing unit included in the processor and analyzer 72. Alternatively, the signal generator 68 may be similar to the type disclosed in U.S. Pat. No. 5,166,908, issued Nov. 24, 1992 to Melvin Montgomery and assigned to the assignee of the present invention.

Accordingly, with the arrangement of gas lift valves 40, 41 and 43 in the well 10, certain operating conditions of the fluid flowing through the tubing string 20 may be determined at each of the gas lift mandrels 24 and the operating condition of the gas lift valve at each of the mandrels may also be determined.

The present invention also contemplates an arrangement whereby the operator 91 for the closure member 84 may be controlled to provide a selected closure member biasing force so as to modify the gas working pressure at which the closure member moves to an open position to admit gas to the tubing string 20. The acoustic signal transmitter 74 may be operated to transmit acoustic signals down through the tubing string 20 to each of the gas lift mandrels and to be sensed by a signal receiver 76. Suitable signals may then be transmitted to the controller 91 to effect a change in the gas pressure which will effect opening of the valve 84. The signal generator or transmitter 74 may be suitably connected to a source of operating power to effect transmission of an identifiable vibratory signal through the tubing string to effect operation of a controller associated with a selected one of each of the gas lift valves 40, 41 and 43 to modify the gas pressure at which the valve is opened to admit gas to the tubing string 20.

The acoustic signal generating and receiving system described above in conjunction with the gas lift valves 40, 41 and 43 is somewhat exemplary, although considered to be a superior way of transmitting signals between the surface 17 and at least selected ones of the gas lift valves interposed in the tubing string 20. Other types of signal transmitting and receiving devices might be utilized in place of those described above including types which generate electromagnetic waves or fluid pulses which may be transmitted through the tubing string 20 and/or the annulus space 32. With the arrangement described above, individual gas lift valves may be monitored under normal or abnormal operating conditions. With knowledge of the operating condition of each of the gas lift valves as well as the pressure, viscosity and temperature conditions in the tubing string at selected locations associated with the gas lift valves, the well operating conditions may be modified to more effectively produce fluids therefrom. Materials used in and certain engineering details of the apparatus described hereinabove are believed to be within the purview of one skilled in the art of wellbore information transmitting and receiving devices and gas lift type valve devices.

The invention may be used in conjunction with wells which produce crude oil, water, coal gas and similar fluids as well as fluid lift systems for use in subsea risers for offshore fluid production platforms, long flowlines and mine dewatering applications, for example. The terms "well" and "production fluid" as used herein may be construed to include such applications of the invention. Although preferred embodiments of the present invention have been described in some detail herein, those skilled in the art will recognize that various substitutions and modifications may be made to the embodiments disclosed without departing from the scope and spirit of the invention as recited in the appended claims.

What is claimed is:

1. In a well for producing fluids, said well comprising:

a wellbore, a tubing string extending within said wellbore and forming an annulus therebetween, said annulus conducting pressure lifting fluid to selected locations along said tubing string;

said tubing string having at least one opening therein at at least one of said selected locations;

a lifting fluid valve interposed in said tubing string having an open and a closed position and a flow passage therethrough and operable to open said at least one opening in said tubing string to admit pressure lifting fluid from said annulus into said tubing through said at least one opening to assist in lifting production fluid through said tubing string;

means positioned at and associated with said lifting fluid valve for generating an acoustical signal indicative of a certain parameter existing at said lifting fluid valve; and a first sensor associated with said lifting fluid valve for sensing said acoustic signal at the surface for determining said certain parameters.

2. The invention of claim 1 wherein said means for generating an acoustical signal includes:

means for determining said open and closed positions of said lifting fluid valve.

3. The invention of claim 2 wherein said means for determining said open and closed positions of said lifting fluid valve comprises:

said at least one opening and said flow passage through said valve being configured whereby said acoustical signal is generated by said pressure lifting fluid flowing therethrough.

4. The invention of claim 2 wherein said means for determining said open and closed positions of said lifting fluid valve comprises:

a valve position sensor within said lifting fluid valve for sensing whether said lifting fluid valve is in an open position or a closed position;

a signal generator associated with said valve position sensor and operable to generate a signal representative of said lifting fluid valve position for transmission through said well to said surface.

5. The invention of claim 4 wherein said signal generator associated with said valve including:

means for imparting said acoustical signal to said tubing string through which said signal is transmitted to said second sensor.

6. The invention of claim 5 wherein said means for imparting said acoustical signal to said tubing string comprises:

a reciprocating mass and pressure fluid control valve operably associated with said mass for effecting reciprocation thereof by pressure fluid to generate vibratory signals in said tubing string.

7. The invention of claim 6 wherein:

said pressure fluid for reciprocating said mass comprises said pressure lifting fluid.

8. The invention of claim 1 wherein said means for generating an acoustical signal includes:

means for sensing the temperature of said production fluid flowing through said tubing and generating said acoustical signal in response thereto.

9. The invention of claim 1 wherein said means for generating an acoustical signal includes:

means for sensing the pressure within said tubing at said lifting fluid valve and generating said acoustical signal in response thereto.

10. The invention of claim 1 wherein said means for generating an acoustical signal includes:

means for sensing the viscosity of said production fluid flowing through said tubing and generating said acoustical signal in response thereto.

11. The invention set forth in claim 1 including:

a signal generator interposed in said tubing string for generating a signal for transmission to a signal receiver associated with said lifting fluid valve.

12. In a well for producing fluids, said well comprising:

a wellbore, a tubing string extending within said wellbore and forming an annulus between said wellbore and said tubing string, said annulus conducting pressure lifting fluid to selected locations along said tubing string;

said tubing string having at least one opening therein at at least one of said selected locations;

a lifting fluid valve interposed in said tubing string and operable to open said at least one opening in said tubing string to admit pressure lifting fluid from said annulus into said tubing through said at least one opening to assist in lifting production fluid through said tubing string; said opening and said valve being configured to generate an identifiable acoustical signal as said pressure lifting fluid flows therethrough; and a first sensor associated with said lifting fluid valve for sensing said identifiable acoustic signal as said pressure lifting fluid flows through said opening and through said lifting fluid valve to thereby indicate when said lifting fluid valve is in an open condition.

13. The invention of claim 12 wherein said at least one opening in said tubing string comprises:

a plurality of openings with at least one said openings being adjacent each of said selected locations along said tubing string;

and further including:

a plurality of lifting fluid valves, one of said lifting fluid valves being positioned at a respective one of said openings in said tubing string and each said lifting fluid valve being operable to open said respective one of said openings to admit pressure lifting fluid from said annulus into said tubing through said respective one opening, each opening and respective lifting fluid valve being configured to produce an identifiable acoustical signal particular to that respective opening and valve as said pressure lifting fluid flows therethrough;

and wherein said first sensor is associated with each of said plurality of said lifting fluid valves for sensing said identifiable acoustic signal from each of said lifting fluid valves as said pressure lifting fluid flows therethrough to thereby indicate which particular, respective lifting fluid valves are in an open condition.

14. The invention of claim 12 including:

a valve position sensor within said lifting fluid valve for sensing whether said lifting fluid valve is in an open position or a closed position;

a signal generator associated with said valve position sensor and operable to generate a signal representative of said lifting fluid valve position for transmission through said well to said surface; and a second sensor within said well for sensing said valve position signal to thereby indicate whether said lifting fluid is in an open or closed condition.

15. The invention of claim 14 wherein said signal generator comprises:

means for generating an acoustical signal which is representative of the position of said valve; and means for imparting said acoustical signal to said tubing string through which said signal is transmitted to said second sensor.

16. The invention of claim 12 including:

sensor means associated with said lifting valve for sensing at least one of pressure, temperature and viscosity of fluid flowing through said tubing string at said lifting fluid valve and means for generating signals for transmission through said well to the surface for indicating at least one of said pressure, temperature and viscosity at said each lifting fluid valve.

17. The invention of claim 12 wherein said at least one lifting fluid valve is removable from said tubing string to the surface.

18. A method for monitoring downhole conditions within a well which has a tubing string for producing fluids to the surface wherein said tubing has a plurality of lifting fluid valves spaced along a portion of its length, each of said lifting fluid valves having a predetermined acoustic signature when fluid flows therethrough, said method comprising:

supplying a pressure lifting fluid down the well annulus to each of said plurality of lifting fluid valves; and sensing the acoustical signals generated by said pressure lifting fluid flowing into said tubing string through each of said lifting fluid valves to thereby identify each of said lifting fluid valves which is in an open condition.

19. The method of claim 18 including:

sensing certain parameters of the fluids being produced through said production tubing at each of said plurality lifting fluid valves and generating signal representative of said parameters; and transmitting said generated signals to said surface.

20. The method of claim 19 wherein said parameters being sensed are at least one of pressure, temperature and viscosity of said fluid being produced through said tubing string.

* * * * *